US008579213B2

(12) United States Patent
Myers

(10) Patent No.: US 8,579,213 B2
(45) Date of Patent: Nov. 12, 2013

(54) SINGLE CIRCUIT MULTIPLE SPRAY CONE PRESSURE ATOMIZERS

(75) Inventor: Steve Jay Myers, Norwalk, IA (US)

(73) Assignee: Delavan Inc., West Des Moines, IA (US)

( * ) Notice: Subject to any disclaimer, the term of this patent is extended or adjusted under 35 U.S.C. 154(b) by 44 days.

(21) Appl. No.: 13/405,747

(22) Filed: Feb. 27, 2012

(65) Prior Publication Data

US 2013/0221135 A1 Aug. 29, 2013

(51) Int. Cl.
*B05B 1/34* (2006.01)

(52) U.S. Cl.
USPC ..... 239/492; 239/463; 239/472; 239/490; 239/491

(58) Field of Classification Search
USPC ..... 239/463, 466, 469, 470, 472, 490, 491, 239/492, 493, 505
See application file for complete search history.

(56) References Cited

U.S. PATENT DOCUMENTS

| | | | | |
|---|---|---|---|---|
| 1,183,393 | A | 5/1916 | Merrell | |
| 2,378,348 | A | 6/1945 | Wilmes et al. | |
| 2,701,164 | A * | 2/1955 | Orent et al. | 239/400 |
| 2,921,747 | A | 1/1960 | Burman | |
| 3,304,013 | A | 2/1967 | O'Brien | |
| 3,441,223 | A | 4/1969 | Lapera | |
| 3,680,793 | A | 8/1972 | Tate et al. | |
| 3,844,484 | A * | 10/1974 | Masai | 239/404 |
| 3,979,069 | A * | 9/1976 | Garofalo | 239/400 |
| 4,079,762 | A | 3/1978 | Hanson, Jr. | |
| 4,087,050 | A * | 5/1978 | Tsuji et al. | 239/490 |
| 4,103,830 | A | 8/1978 | Roth | |
| 4,258,885 | A | 3/1981 | Legeza | |
| 4,307,840 | A | 12/1981 | Schulze et al. | |
| 4,395,874 | A * | 8/1983 | Striebel et al. | 60/39.58 |
| 4,618,101 | A | 10/1986 | Piggott | |
| 4,736,893 | A | 4/1988 | Norskov | |
| 5,934,569 | A | 8/1999 | Soule et al. | |
| 6,193,172 | B1 | 2/2001 | Soule et al. | |
| 6,425,755 | B1 * | 7/2002 | Pillard et al. | 431/159 |

FOREIGN PATENT DOCUMENTS

| | | |
|---|---|---|
| EP | 0430858 A2 | 6/1991 |
| WO | WO-9911382 A1 | 3/1999 |

OTHER PUBLICATIONS

European Search Report dated Jul. 27, 2007.

* cited by examiner

*Primary Examiner* — Ryan Reis
(74) *Attorney, Agent, or Firm* — Edwards Wildman Palmer LLP; Scott D. Wofsy; Joshua L. Jones

(57) ABSTRACT

An atomizer includes an atomizer body having a liquid inlet and a spray outlet with a liquid flow circuit defined through the inner atomizer body for fluid communication of liquid from the inlet to the spray outlet. The liquid flow circuit branches into a plurality of sub-circuits. Each sub-circuit is configured to produce a spray cone of atomized liquid issuing from the spray outlet such that the spray cone of each sub-circuit has a different cone angle. The sub-circuits are mechanically separated from one another to limit interaction of liquid in the sub-circuits and thereby produce a distinct and stable spray cone from each sub-circuit over a range of liquid flow rates.

16 Claims, 10 Drawing Sheets

SINGLE CIRCUIT MULTIPLE SPRAY CONE PRESSURE ATOMIZERS

BACKGROUND OF THE INVENTION

1. Field of the Invention

The present invention relates to injectors and nozzles for spaying liquids, and more particularly to pressure atomizers.

2. Description of Related Art

A variety of devices are known for producing a spray from a pressurized liquid. Many of these are pressure atomizers designed to atomize fuel, water, or other liquids into a fine spray of droplets. Pressure atomizers can be made relatively small and therefore lend themselves to applications where space is limited. An exemplary pressure atomizer or nozzle is described in U.S. Pat. No. 3,680,793 to Tate et al.

In traditional configurations, the spray produced from a pressure atomizer has a shape that changes depending on the applied flow rate and pressure. Typically a pressure atomizer will produce a spray shape that varies from a discrete jet, to a solid cone, to a hollow cone, as the applied pressure and flow rate increase.

In various applications, such as in combustors of gas turbine engines, for example, it is desirable to have a consistent spray shape over the entire range of operating pressures and flow rates. A solid cone spray is ideal for many applications. However, as described above, traditional pressure atomizers typically produce a solid spray cone only at a certain applied pressure, and at other pressures produce a hollow cone or discrete jet.

Such conventional methods and systems have generally been considered satisfactory for their intended purpose. However, there is still a need in the art for atomizers that allow for improved performance over a wide range of applied pressures and flow rates. The present invention provides a solution for these problems.

SUMMARY OF THE INVENTION

The subject invention is directed to a new and useful atomizer for producing an atomized spray of liquid. The atomizer includes an atomizer body having a liquid inlet and a spray outlet with a liquid flow circuit defined through the inner atomizer body for fluid communication of liquid from the inlet to the spray outlet. The liquid flow circuit branches into a plurality of sub-circuits. Each sub-circuit is configured to produce a spray cone of atomized liquid issuing from the spray outlet such that the spray cone of each sub-circuit has a different cone angle. The sub-circuits are mechanically separated from one another to limit interaction of liquid in the sub-circuits and thereby produce a distinct and stable spray cone from each sub-circuit over a range of liquid flow rates.

In certain embodiments, the plurality of sub-circuits includes a first sub-circuit and a second sub-circuit. At least one passage can fluidly connect the liquid inlet with an annular chamber defined in the atomizer body, wherein the annular chamber is in fluid communication with both of the first and second sub-circuits to supply liquid to both. An annular wall can separate the annular chamber from a swirl chamber of the first sub-circuit inboard of the annular chamber. The swirl chamber can be in fluid communication with the annular chamber to receive liquid therefrom via at least one first sub-circuit passage defined through the annular wall.

It is contemplated that in certain embodiments, a first metering orifice is in fluid communication with the swirl chamber of the first sub-circuit. The first metering orifice defines an elongate passage through a protrusion defined on an inner distributor mounted to the atomizer body with the protrusion extending axially away from the annular chamber. The first and second sub-circuits can correspond to separate liquid outlets. The second sub-circuit can include at least one passage connecting the annular chamber to a second metering orifice defined outboard of the inner distributor and inboard of an outer distributor mounted outboard of the inner distributor. The outer distributor can extend beyond the inner distributor in a downstream axial direction. The second metering orifice can define a converging annular passage between the inner and outer distributors.

The protrusion of the inner distributor can separate the outlet portions of the first and second sub-circuits to limit interaction of liquid in the sub-circuits and thereby produce a distinct and stable spray cone from each sub-circuit over a range of liquid flow rates. The annular chamber described above can feed into the outlet orifice of the outer distributor. The inner distributor can include at least one passage, such as a swirl passage, fluidly connecting the annular chamber of the atomizer body to outlet orifice of the outer distributor. The swirl chamber described above can feed into the outlet orifice of the inner distributor. The outlet orifice of the outer distributor can define a converging annular passage between the inner and outer distributors.

In certain embodiments, the atomizer can include a second liquid flow circuit defined through the atomizer body outboard of the first and second sub-circuits of the first liquid flow circuit. An outer atomizer body can be mounted outboard of the outer distributor and atomizer body described above. The second liquid flow circuit can be defined between the inner atomizer body and the outer atomizer body.

It is also contemplated that a third sub-circuit of the first liquid flow circuit can be defined between the outer atomizer body and the outer distributor. In such embodiments, at least one separate passage can be defined in the inner atomizer body to fluidly connect the liquid inlet with the third sub-circuit. The outer distributor can include an axially extending protrusion outboard of the protrusion of the inner distributor to provide mechanical separation between outlet portions of the second and third sub-circuits. The separation of the outlet portions of the sub-circuits limits interaction of liquid in the sub-circuits and thereby produces a distinct and stable spray cone from each sub-circuit over a range of liquid flow rates. The third sub-circuit can be configured to produce a spray with a wider spray cone angle than that of the second sub-circuit. The second sub-circuit can in turn be configured to produce a spray with a wider spray cone angle than that of the first sub-circuit.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein.

DETAILED DESCRIPTION OF THE PREFERRED EMBODIMENTS

Figure 5:
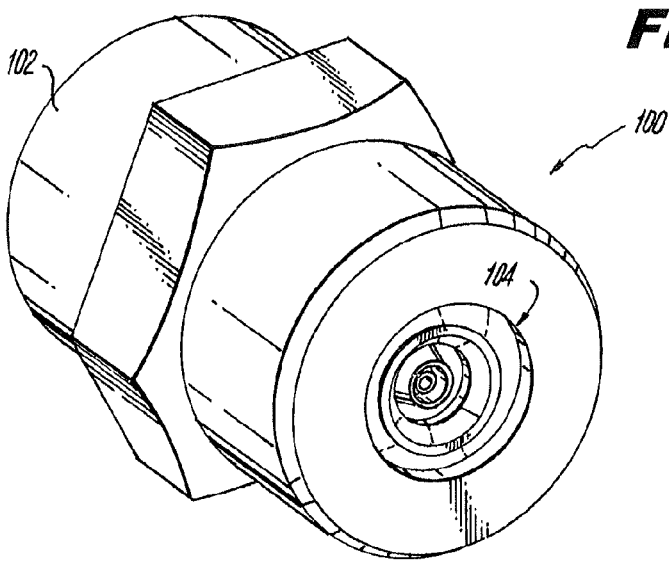
FIG. 5 is a perspective view of an exemplary embodiment of an atomizer constructed in accordance with the present invention, showing the atomizer outlet.

Reference will now be made to the drawings wherein like reference numerals identify similar structural features or aspects of the subject invention. For purposes of explanation and illustration, and not limitation, a partial view of an exemplary embodiment of an atomizer in accordance with the invention is shown in FIG. 5 and is designated generally by reference character 100. Other embodiments of atomizers in accordance with the invention, or aspects thereof, are provided in FIGS. 6-20, as will be described. The systems of the invention can be used to produce atomized sprays of liquid with a substantially solid spray cones over a range of pressures.

Figure 1:
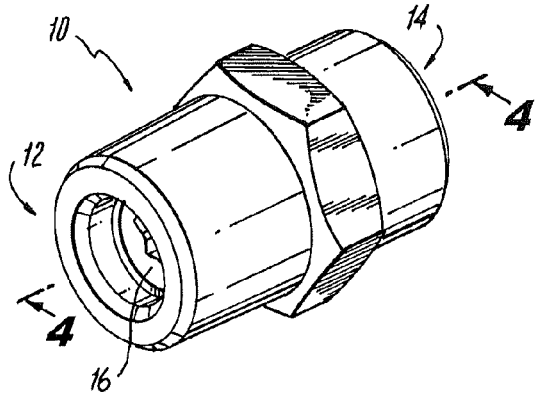
Fig. 1 (Prior Art)
FIG. 1 is a perspective view of a prior art atomizer, showing the inlet portion.
Figure 2:
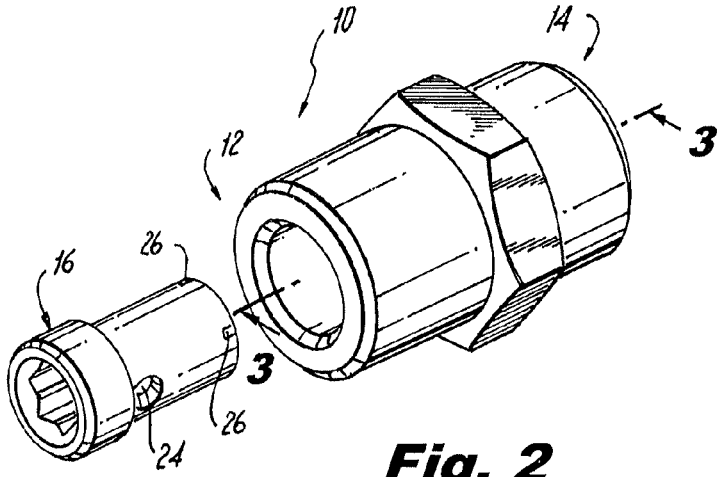
Fig. 2 (Prior Art)
FIG. 2 is a perspective view of the atomizer of FIG. 1, showing the core removed.
Figure 3:
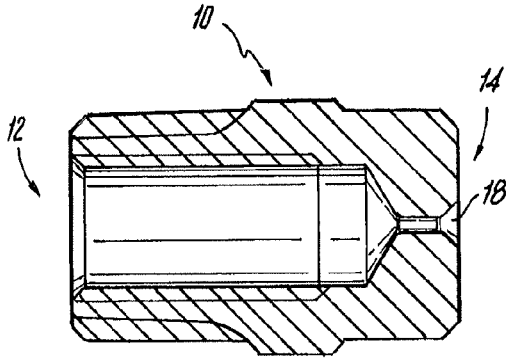
Fig. 3 (Prior Art)
FIG. 3 is a cross-sectional elevation view of the atomizer of FIG. 1, showing the outlet orifice and showing the core removed.
Figure 4:
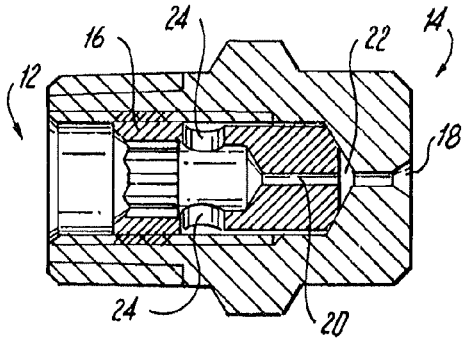
Fig. 4 (Prior Art)
FIG. 4 is a cross-sectional elevation view of the atomizer of FIG. 1, showing the core in place.

With reference first to FIG. 1, a pressure atomizer 10 of the prior art is shown having an inlet end 12 and an outlet end 14. A core 16, shown separately in FIG. 2, divides the flow internally to produce a solid spray cone. Outlet end 14 includes a single outlet orifice 18, shown in FIG. 3, which is fed from two sources. First, with reference to FIG. 4, flow enters core 16 and flows through the central bore 20 thereof to into spin chamber 22. Second, flow enters core 16 and passes laterally through bores 24 to a space between core 16 and the main body of atomizer 10. From this space, the flow passes through slots 26, shown in FIG. 2, into spin chamber 22. Slots 26 are radially off-center and therefore impart swirl on the combined flow from bore 20 and slots 26 within spin chamber 22. This combined, spinning flow passes through bore 18 to become an atomized spray cone.

Figure 6:
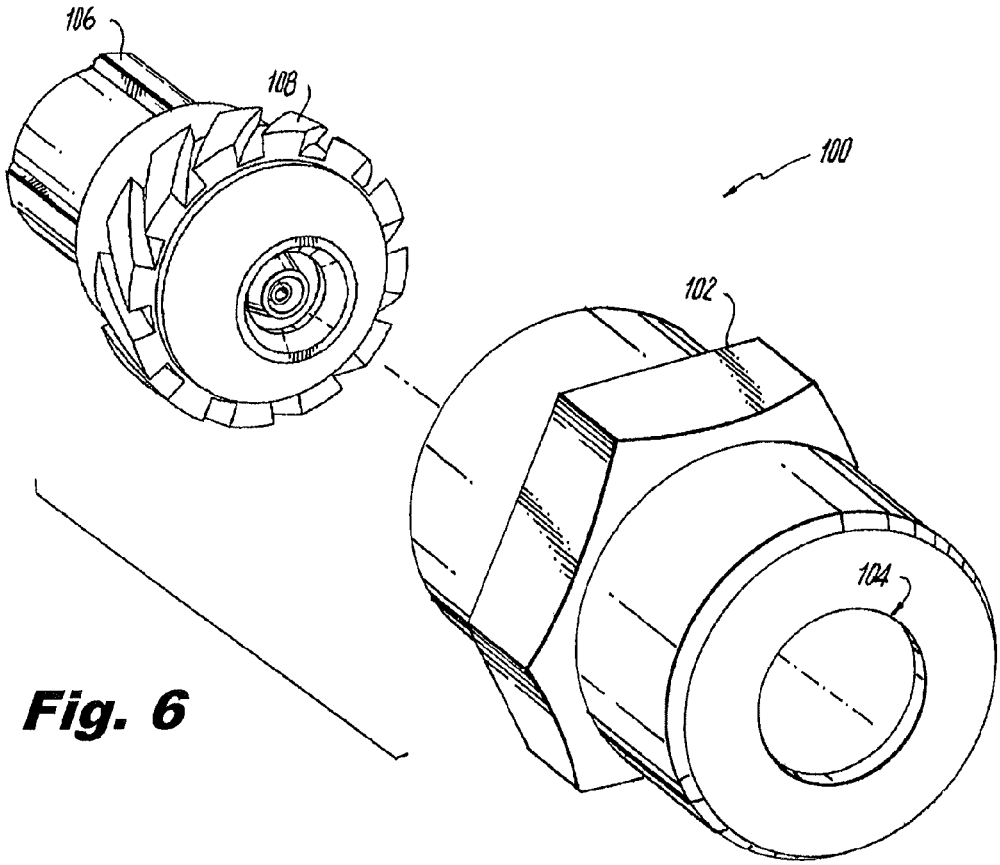
FIG. 6 is an exploded perspective view of the atomizer of FIG. 5, showing the housing removed.

Referring now to FIG. 5, a pressure atomizer 100 in accordance with the present invention includes a plurality of sub-circuits, and maintains mechanical separation between the sub-circuits for improved spray cone characteristics. Atomizer 100 includes a housing 102 with an outlet opening 104. As shown in FIG. 6, housing 102 houses inner and outer atomizer bodies 106 and 108.

Figure 7:
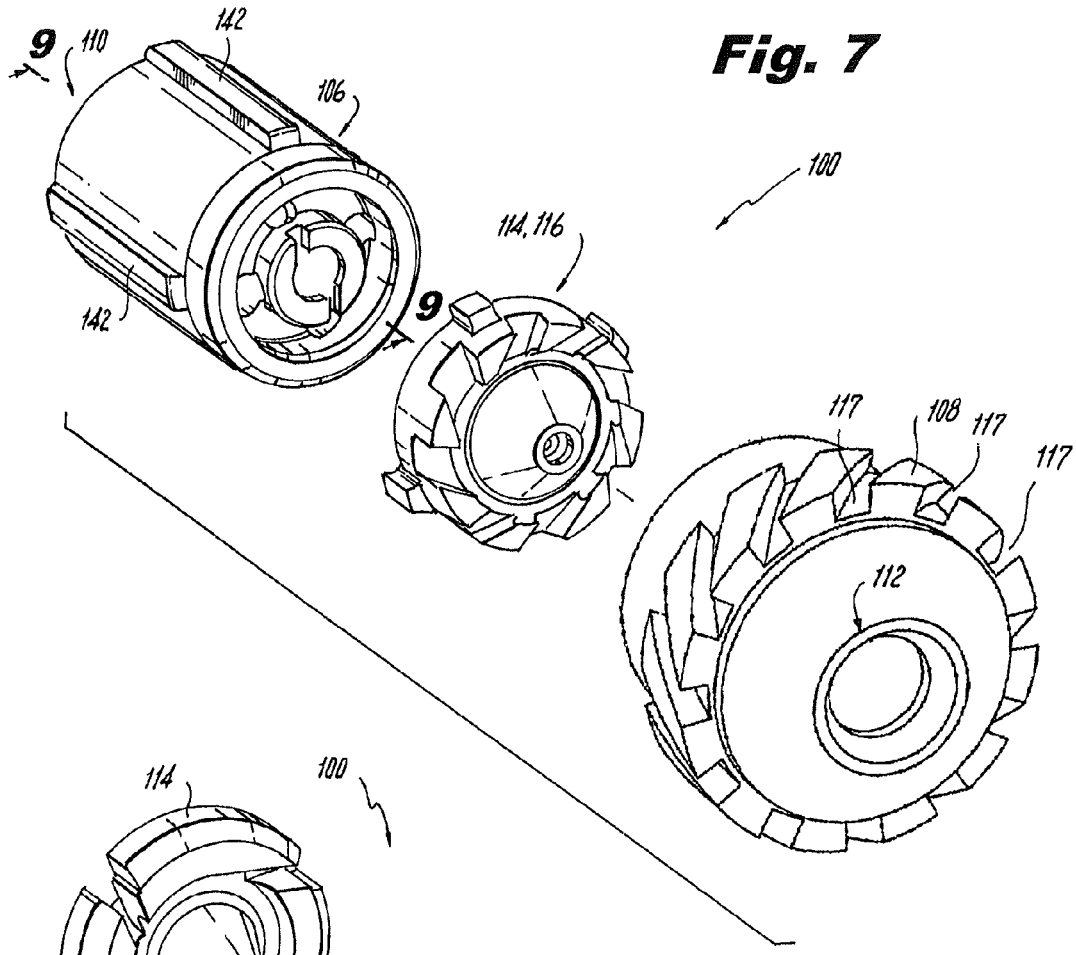
FIG. 7 is an exploded perspective view of the atomizer of FIG. 6, showing the outer atomizer body and the inner and outer distributors removed from the inner atomizer body.
Figure 8:
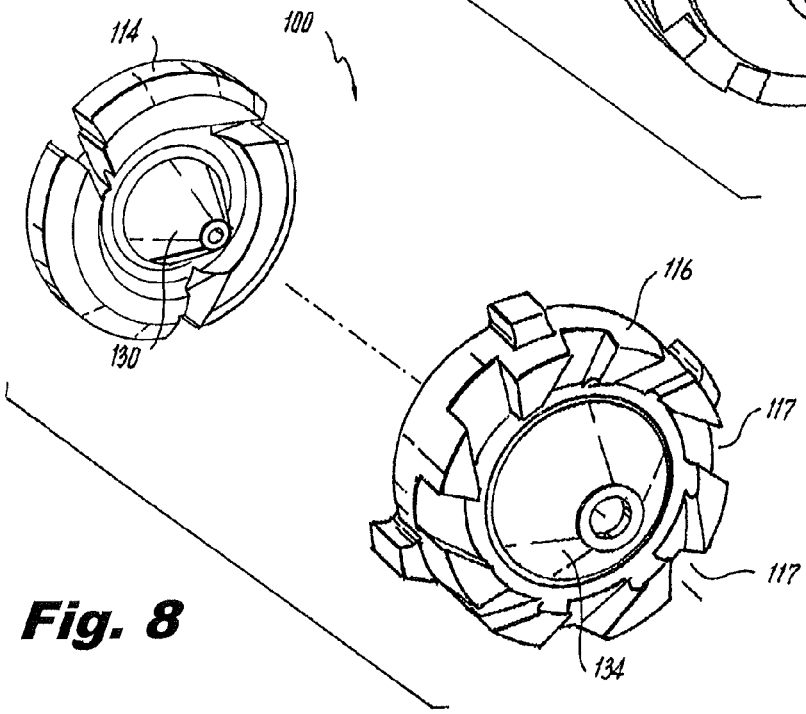
FIG. 8 is an exploded perspective view of the inner and outer distributors of FIG. 7, showing the axial protrusion of each distributor.

Referring now to FIG. 7, inner and outer atomizer bodies 106 and 108 form a main atomizer body and include a liquid inlet 110 and a spray outlet 112, respectively. A liquid flow circuit is defined through the inner atomizer body 106 for fluid communication of liquid from inlet 110 to the spray outlet 112. The liquid flow circuit branches into a plurality of sub-circuits. Each sub-circuit is configured to produce a spray cone of atomized liquid issuing from the spray outlet such that the spray cone of each sub-circuit has a different cone angle. Inner and outer distributors 114 and 116, shown separately in FIG. 8, are mounted to inner atomizer body 106 to mechanically separate the first and second sub-circuits from one another to limit interaction of liquid in the sub-circuits and thereby produce a distinct and stable spray cone from each sub-circuit over a range of liquid flow rates. Outer distributor 116 includes swirl slots 117 for imparting swirl onto liquid passing through the second liquid circuit described below.

Figure 9:
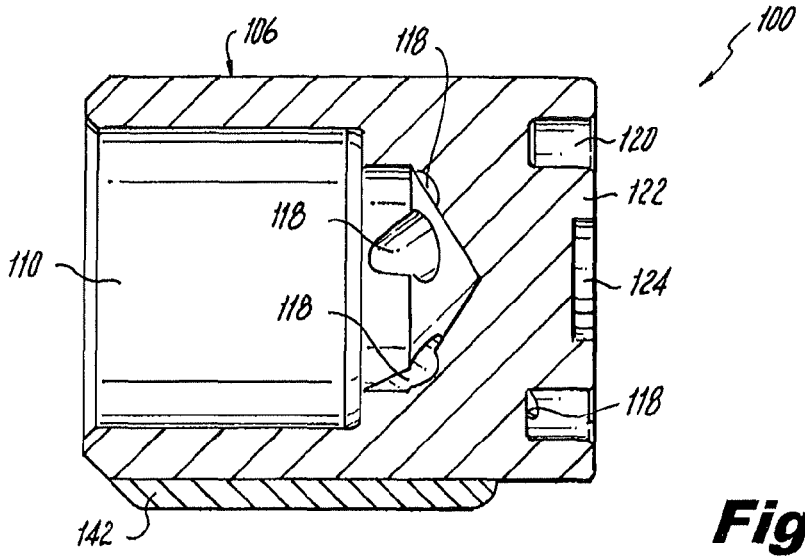
FIG. 9 is across-sectional side elevation view of the inner atomizer body of FIG. 7, showing the liquid inlet, annular chamber, and swirl chamber.
Figure 12:
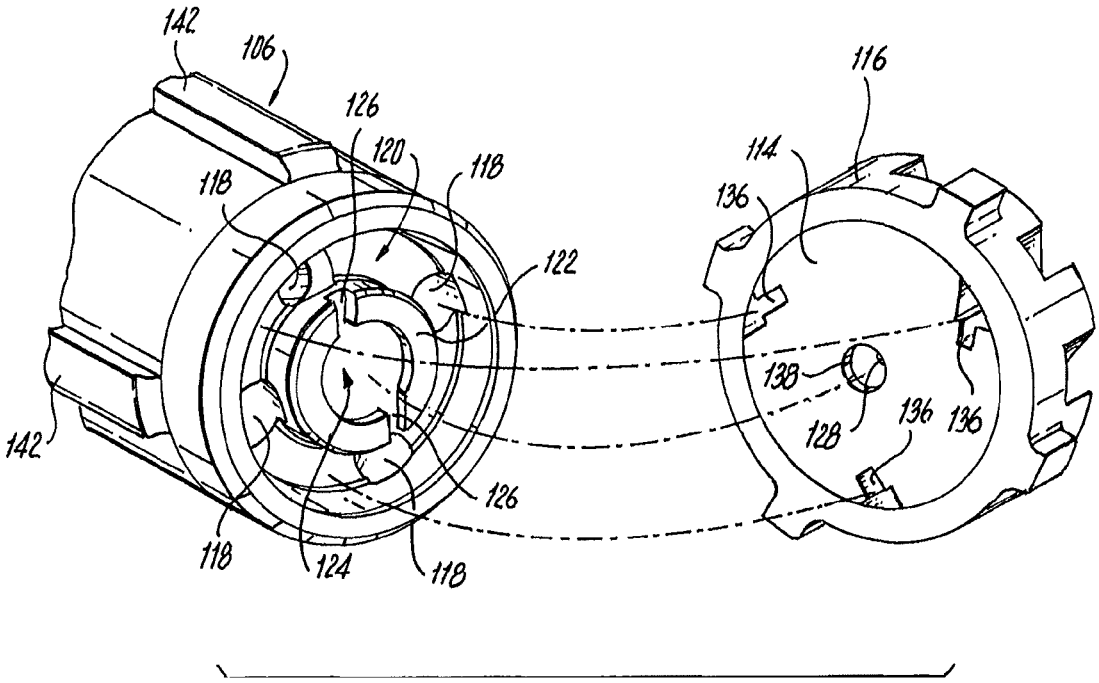
FIG. 12 is an exploded perspective view of a portion of the inner atomizer body and the inner and outer distributors of FIG. 7, schematically indicating the fluid communication from the annular chamber to the portions of each of the first and second sub-circuits in the inner and outer distributors.

Referring now to FIG. 9, four passages 118 provide fluid communication from inlet 110 to an annular chamber 120 defined in the outlet end of atomizer body 106. Annular chamber 120 is in fluid communication with both of the first and second sub-circuits to supply liquid to both. An annular wall 122 separates annular chamber 120 from a swirl chamber 124 of the first sub-circuit inboard of the annular chamber 120. Swirl chamber 124 is in fluid communication with annular chamber 120 to receive liquid therefrom via first sub-circuit swirl passages 126 defined through annular wall 122. As shown in FIG. 12, swirl passages 126 are off-center radially with respect to swirl chamber 124 for imparting swirl on fluids of the first sub-circuit flowing into swirl chamber 124.

Figure 10:
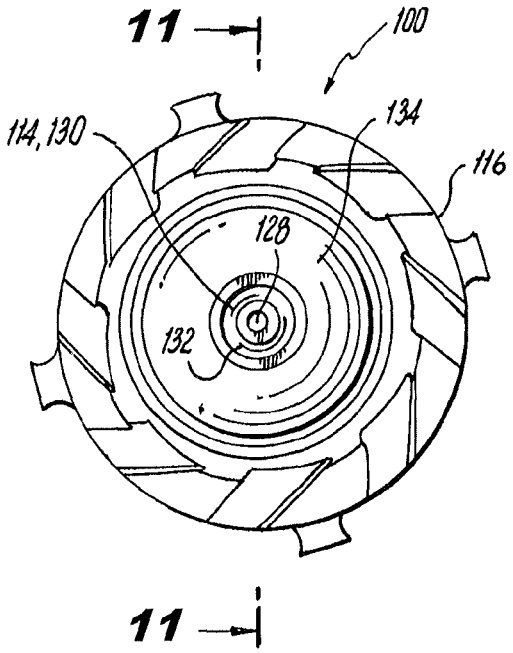
FIG. 10 is a outlet end elevation view of the inner and outer distributors of FIG. 7, showing the outlet orifice of each of the first and second sub-circuits of the liquid flow circuit.
Figure 11:
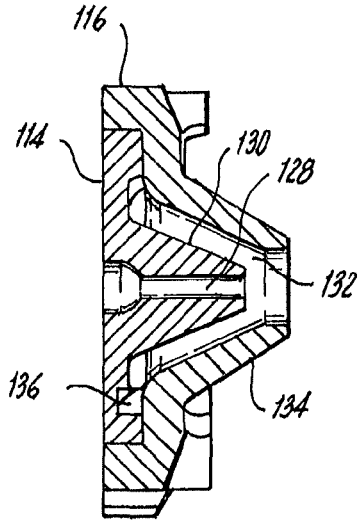
FIG. 11 is a cross-sectional side elevation view of the inner and outer distributors of FIG. 10, showing the outlet portions of the first and second sub-circuits of the liquid flow circuit.
Figure 14:
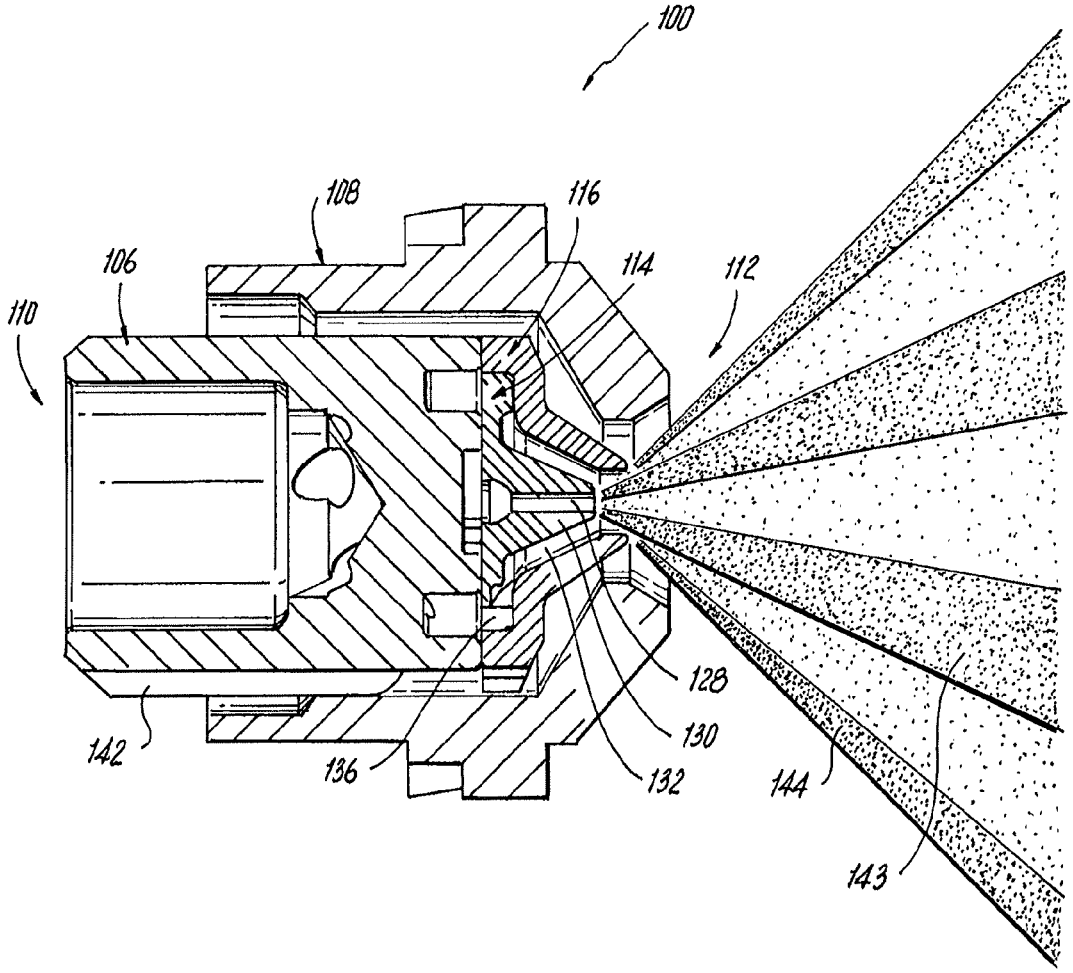
FIG. 14 is cross-sectional side elevation view of the atomizer of FIG. 5, schematically showing the spray angles of the spray cones.

With reference to FIG. 10, a first metering orifice 128 is in fluid communication with the swirl chamber 124 of the first sub-circuit. As shown in cross-section in FIG. 11, metering orifice 128 defines an elongate passage through a protrusion 130 defined on inner distributor 114. As shown in FIG. 14, protrusion 130 extends axially away from annular chamber 120. With outer distributor 116 mounted outboard of inner distributor 114, a second metering orifice 132 is defined as an annular opening between protrusion 130 and a corresponding axially extending protrusion 134 of outer distributor 116. Second metering orifice 132 defines a converging annular passage between the inner and outer distributors 114 and 116. Each of orifice 128 and orifice 132 provides a separate liquid outlet for a respective one of the first and second sub-circuits.

Referring now to FIG. 12, the first and second sub-circuits separate from one another downstream of annular chamber 120, which serves as an outlet from inner atomizer body 106 for the first and second sub-circuits. Liquid passes into the first sub-circuit through swirl passages 126, into swirl chamber 124, and from there through opening 138 which feeds into metering orifice 128 described above. Three swirl passages 136 are defined in inner distributor 114, cooperating with the inner surface of outer distributor 116, for passage of liquid from annular chamber 120 into the second sub-circuit. Liquid passing through swirl passages 136 flows to second metering orifice 132, and swirl passages 136 are angled to impart swirl onto the liquid passing into orifice 132.

Figure 13:
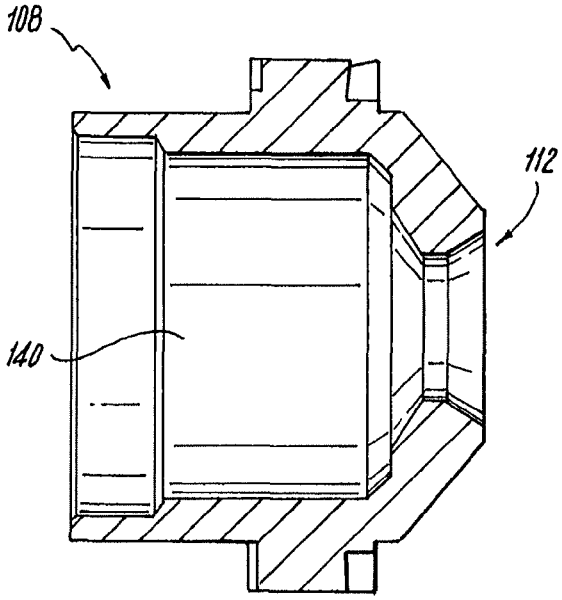
FIG. 13 is a cross-sectional side elevation view of the outer atomizer body of FIG. 7, showing the converging outlet orifice for the second liquid flow circuit.

With reference now to FIG. 13, atomizer 100 includes a second liquid flow circuit defined through the main atomizer body outboard of the first and second sub-circuits of the first liquid flow circuit Inner surface 140 of outer atomizer body 108 is mounted to standoffs 142 of inner atomizer body 106, which are shown in FIG. 12. This places outer atomizer body 108 outboard of outer distributor 116 and inner atomizer body 106, as shown in FIG. 14. The second liquid flow circuit is defined between the inner and outer atomizer bodies 106 and 108, so liquid can flow between standoffs 142, through the converging space between outer distributor 116 and the outlet end of outer atomizer body 108, and out through spray outlet 112.

With continued reference to FIG. 14, the outlet end of outer distributor 116 extends beyond the outlet end of inner distributor 114 in a downstream axial direction. This helps to keep the two spray cones distinct, minimizing interaction between the spray cones and promoting spray stability. Protrusion 130 of inner distributor 114 separates the outlet portions of the first and second sub-circuits to limit interaction of liquid in the sub-circuits and thereby produce a distinct and stable spray cone at outlet 112 from each sub-circuit over a range of liquid flow rates. The first sub-circuit produces an inner spray cone 143 from metering orifice 128, and the second sub-circuit produces an outer spray cone 144 from metering orifice 132, outboard of inner spray cone 143.

Figure 15:
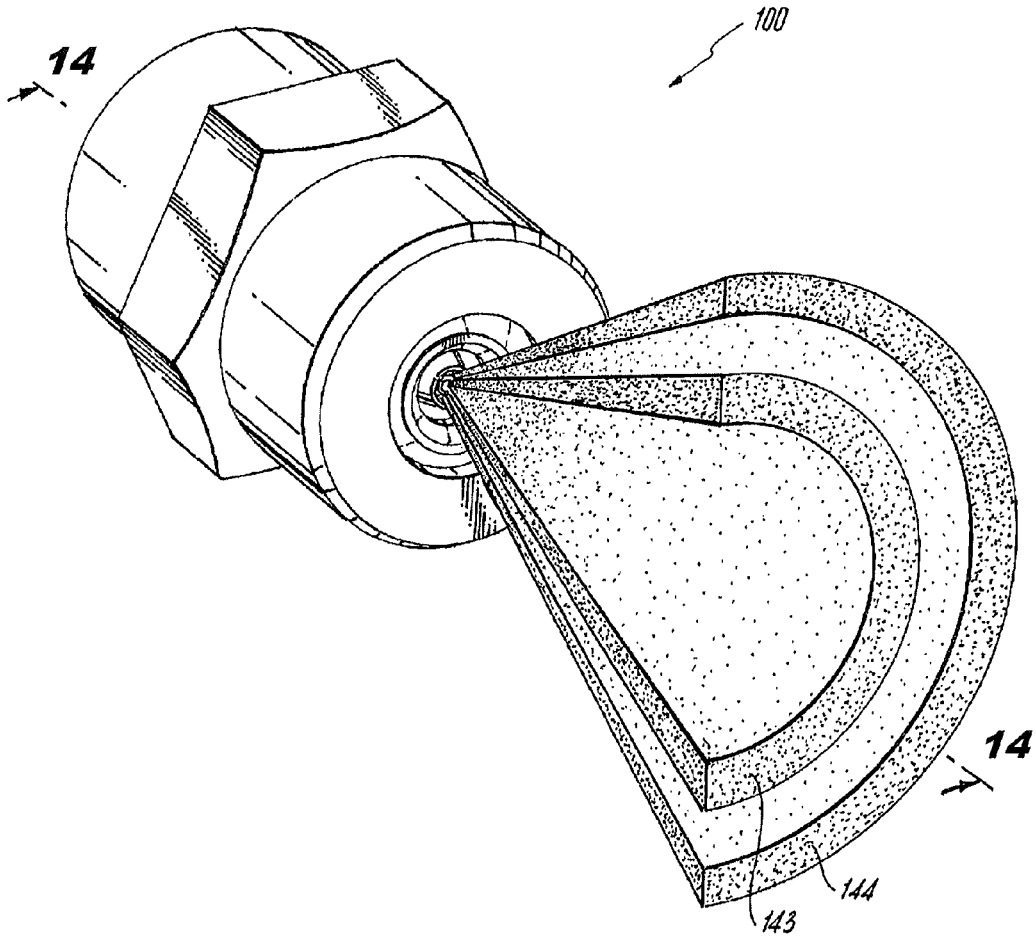
FIG. 15 is a perspective view of the atomizer of FIG. 5, schematically showing the spray cones of the first and second sub-circuits, and indicating the cross-section shown in FIG. 14.

While each of the spray cones 143 and 144 is shown schematically as a hollow cone in FIG. 14, in practice the spray cones 143 and 144 are made of atomized droplets and do not have discrete boundary surfaces downstream of outlet 112. Instead, the droplets of the two spray cones interact with one another to produce an overall spray pattern that forms a more uniform distribution in the entire spray area. Since spray cones 143 and 144 are both produced from separate sub-circuits of the same liquid circuit, pressurizing the liquid circuit at inlet 110 produces a relatively solid spray cone downstream of outlet 112, and as the pressure varies at inlet 110, the two spray cones 143 and 144 interact to ensure a substantially solid spray cone is produced over the range of inlet pressures. The spray cones 143 and 144 are indicated in FIG. 15 with stippling, which shows the overall solid cone spray produced. The wider outer spray cone 144 provides a wide, well atomized spray required for ignition in a combustor, for example. The narrower inner spray cone 143 provides a higher velocity spray for penetration farther downstream, for example deeper into the combustor. The mechanical separation between the sub-circuits within atomizer 100 is what allows the solid cone of the multi-cone spray to be maintained over a wide range of flow rates, as opposed to atomizer 10 described above, in which the sub-circuits recombine and mix in spin chamber 22 before being sprayed out a common outlet. The second liquid circuit is not shown producing a spray cone in FIGS. 14-15 for clarity. The second liquid circuit can be operated independent of the first liquid circuit, for example for fuel staging in gas turbine engines.

The flow split for the two sub-circuits can be critical to proper spray cone interaction. For atomizer 100, the flow spilt is 40% flow through the first sub-circuit and 60% through the second sub-circuit. The metering orifices 128 and 132 and swirl passages 126 and 136 are dimensioned to meter flow in the sub-circuits to maintain the flow split. Those skilled in the art will readily appreciate that the flow split can be altered as appropriate for specific applications without departing from the spirit and scope of the invention.

Figure 16:
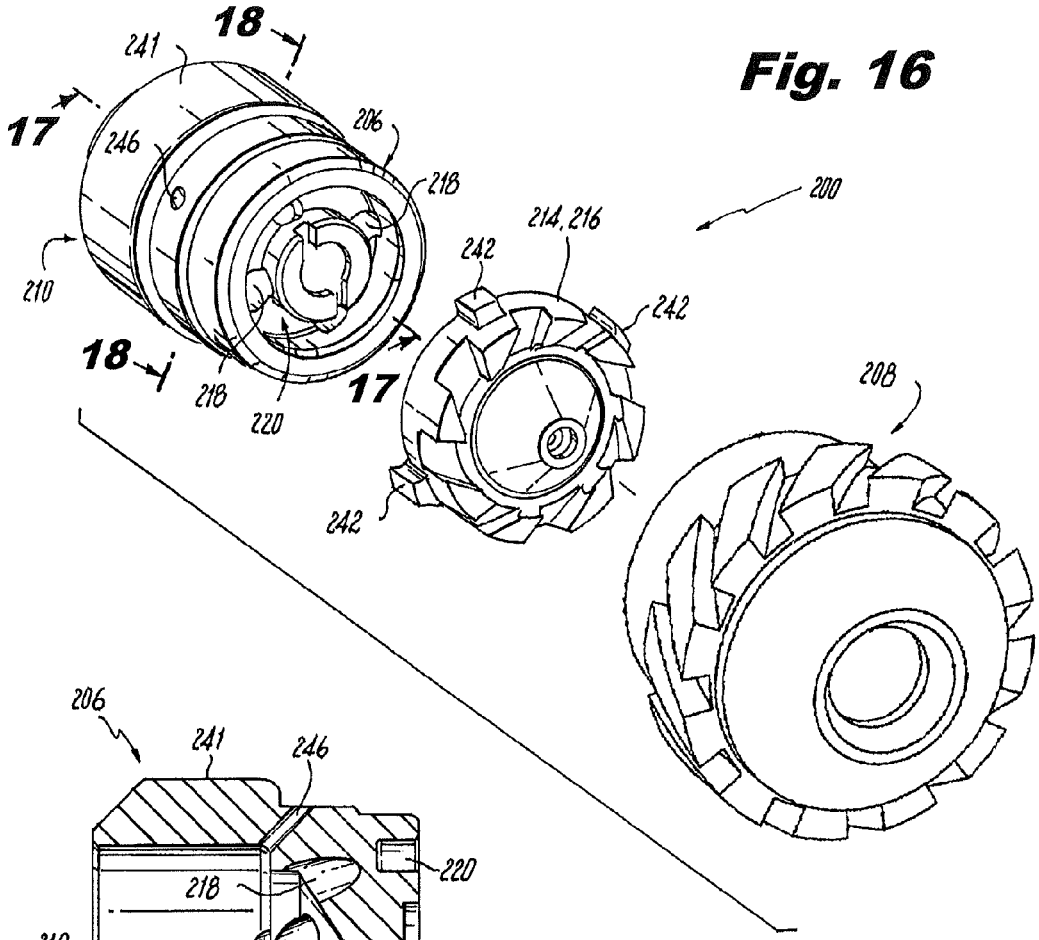
FIG. 16 is an exploded perspective view of an exemplary embodiment of an atomizer with a liquid flow circuit having three sub-circuits, showing the outer atomizer body and the inner and outer distributors removed from the inner atomizer body.
Figure 17:
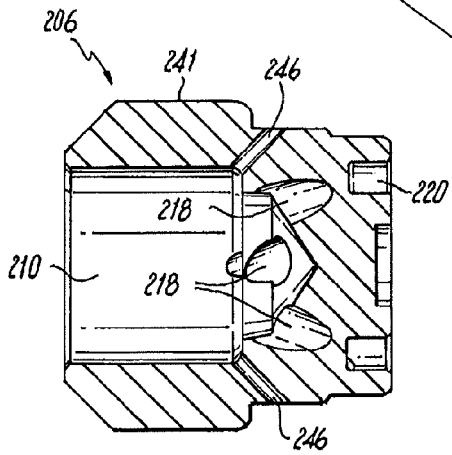
FIG. 17 is a cross-sectional side elevation view of the inner atomizer body of FIG. 16, showing the passages from the liquid inlet to the third sub-circuit.
Figure 18:
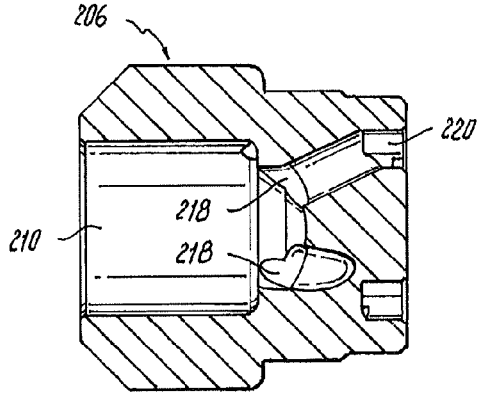
FIG. 18 is a cross-sectional side elevation view of the inner atomizer body of FIG. 16, showing one of the passages from the liquid inlet into the annular chamber at the cross-section indicated in FIG. 16.

Referring now to FIG. 16, another exemplary embodiment of an atomizer 200 is described that includes an inner atomizer body 206, outer atomizer body 208, inner distributor 214, outer distributor 216 similar to those described above with respect to atomizer 100. Inner atomizer 206 includes passages 218 for feeding liquid from inlet 210 to annular chamber 220, as described above with respect to atomizer 100. FIGS. 17 and 18 show passages 218 in the two different cross-sections indicated in FIG. 16 do demonstrate the compound angle of passages 218, which diverge and impart swirl on liquid fed into annular chamber 220.

Figure 19:
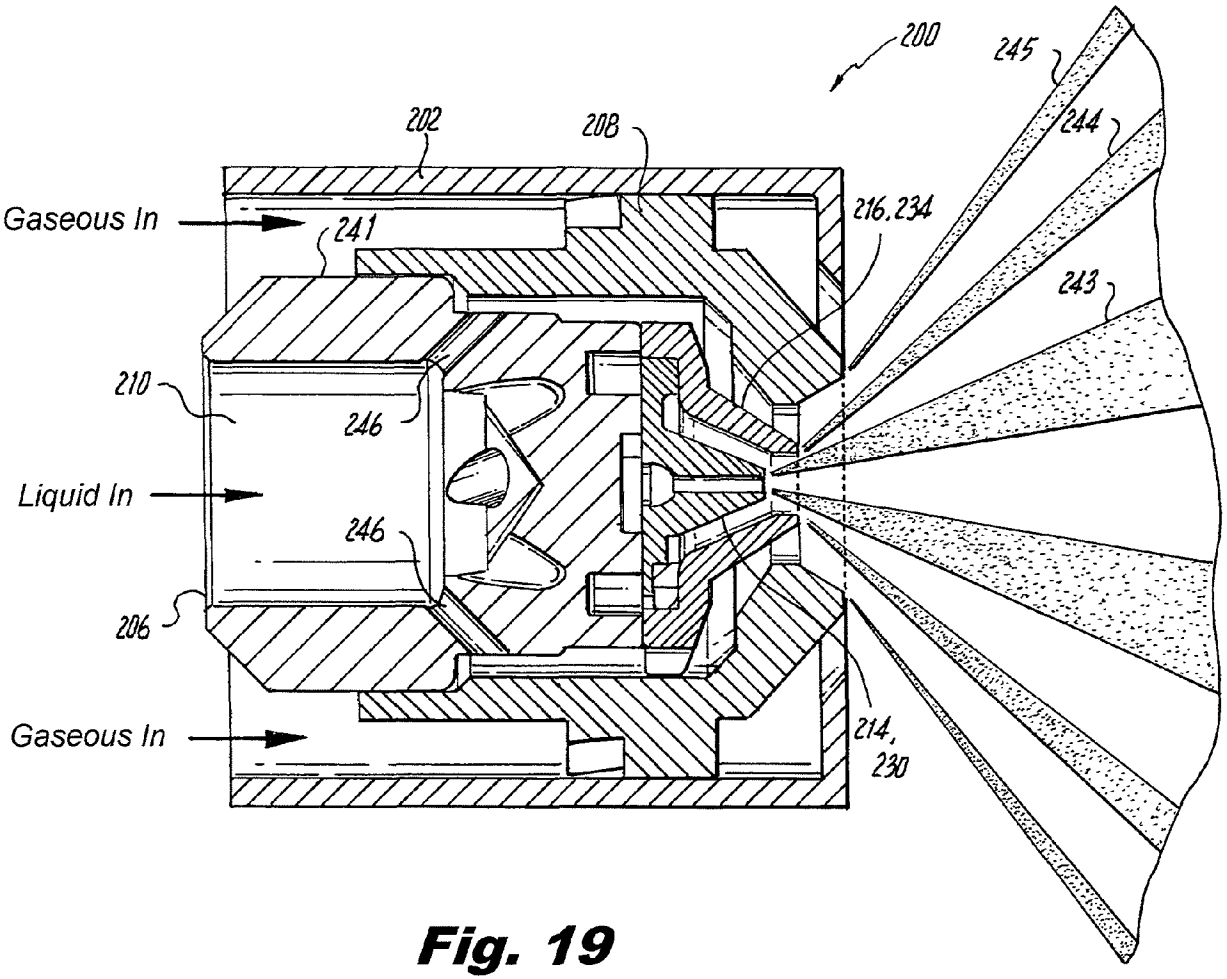
FIG. 19 is cross-sectional elevation view of the atomizer of FIG. 16, schematically showing the spray angles of the spray cones.
Figure 20:
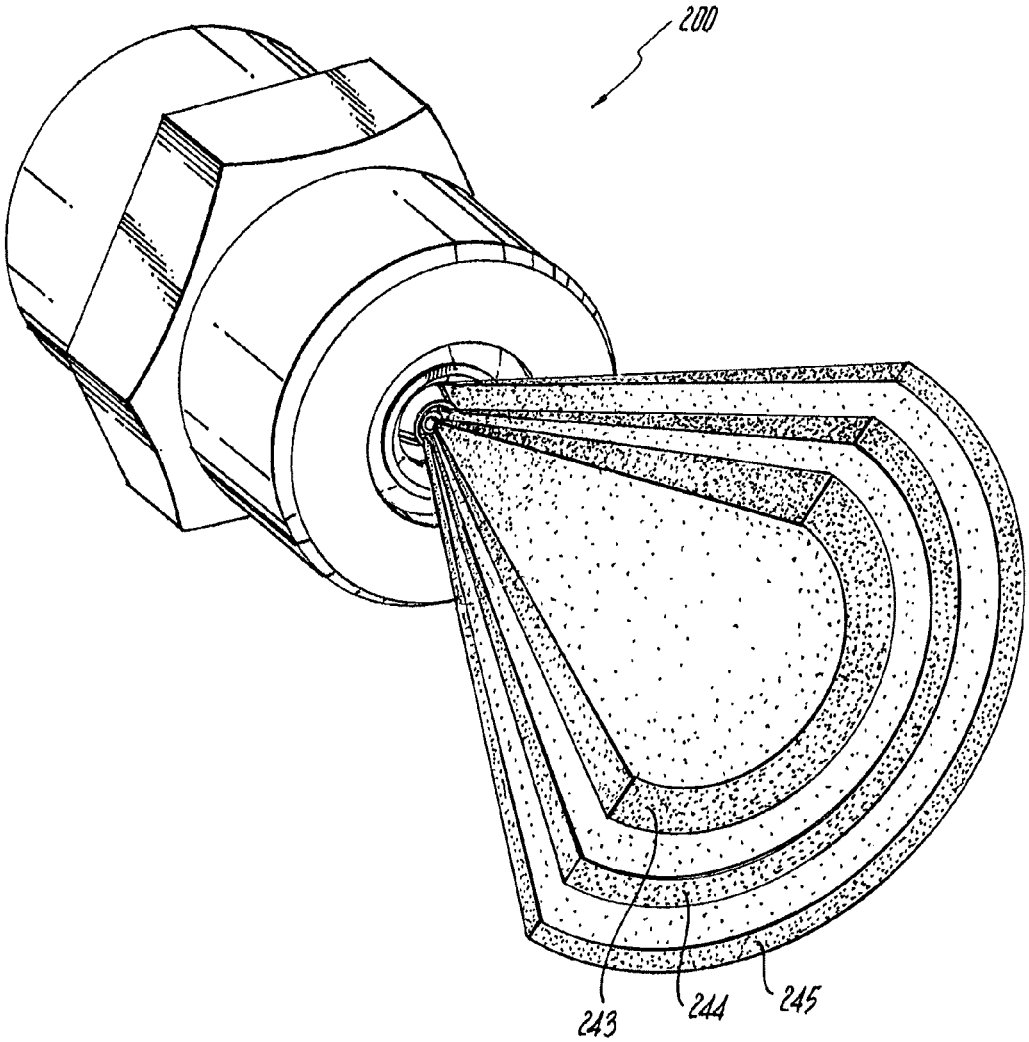
FIG. 20 is a perspective view of the atomizer of FIG. 16, schematically showing the spray cones of the first, second, and third sub-circuits.

With reference to FIG. 19, whereas atomizer 100 includes two liquid circuits, one of which divides into two sub-circuits, atomizer 200 includes a single liquid circuit with three sub-circuits. Instead of having standoffs on inner atomizer body 206, e.g., standoffs 142 described above, inner atomizer body 206 includes a land 241 that is continuous around the circumference of inner atomizer body 206. Outer atomizer body 208 is mounted to land 241 and forms a seal therewith. Standoffs 242 are included on outer distributor 216 for mounting outer atomizer body 208 outboard of outer distributor 216. The first and second sub-circuits of atomizer 200 are essentially the same as those described above with respect to atomizer 100. The third sub-circuit is defined between the outer atomizer body 208 and both of the outer distributor 216 and the inner atomizer body 206. Passages 246 are defined in inner atomizer body 206 to provide fluid communication from inlet 210 to the third sub-circuit. The seal between land 241 and outer atomizer body 208 prevents back flow of liquids in the third sub-circuit.

Protrusion 230 of the inner distributor 214 separates outlet portions of the first and second sub-circuits, as described above. Axially extending protrusion 234 of outer distributor 216 provides mechanical separation between outlet portions of the second and third sub-circuits for the same purpose. The separation of the outlet portions of the sub-circuits limits interaction of liquid in the sub-circuits within atomizer 200 and thereby produces a distinct and stable spray cone from all three sub-circuits, as shown schematically in FIG. 20. As described above with respect to atomizer 100, the interaction of the three spray cones 243, 244, and 245 provides a substantially solid overall spray cone pattern over a range of liquid flow rates. Three cones/sub-circuits can produce an even more solid overall spray cone over a range of pressures than two cones/sub-circuits. As shown in FIG. 19, the third sub-circuit produces a spray cone 245 with a wider spray cone angle than that of spray cone 244 of the second sub-circuit. The second sub-circuit in turn produces a spray cone 244 with a wider spray cone angle than that of spray cone 243 of the first sub-circuit. Housing 202 can optionally form a gaseous circuit around inner and outer atomizer bodies 206 and 208, with a gaseous swirler formed in outer atomizer body 208 for swirling the gaseous flow. The gaseous flow could be air, natural gas, or any other suitable gas. The flows of air and liquid are indicated schematically in FIG. 19. The gaseous circuit can help atomize the liquid spray, can supply combustion air, and/or can help shape the spray cone. The gaseous circuit can also help prevent re-circulation of fuel onto the surface of atomizer body 208.

While described above in the context of sub-circuits with different spay angles from one another, those skilled in the art will readily appreciate that an inner sub-circuit can have the same spray angle as a corresponding outer sub-circuit without departing from the spirit and scope of the invention. For example, an inner sub-circuit spray angle can be the same as the corresponding outer sub-circuit, but at different apex locations, see, e.g., FIG. 14 which shows two different apex locations for two sub-circuits. Generally, if the outer sub-circuit's apex is downstream of the inner sub-circuit's apex, the two spray angles will not interact and integrate into a combined single spray angle. In certain applications, it may be best for the inner of two sub-circuits to have a slightly narrower spray angle than the outer sub-circuit to avoid spray combination.

While it has been described above in the exemplary context of two or three sub-circuits producing spray cones from a single main flow circuit, those skilled in the art will readily appreciate that any suitable number of sub-circuits or main circuits can be included. While described in the exemplary context of fuel atomization for gas turbine engines, those skilled in the art will readily appreciate that any suitable atomization fluid can be used and any suitable application can benefit from the systems and methods of the invention without departing from its spirit and scope.

The methods and systems of the present invention, as described above and shown in the drawings, provide for pressure atomizers with superior properties including the ability to produce a substantially solid cone spray over a range of applied pressures and flow rates. While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. An atomizer for producing an atomized spray of liquid comprising: an atomizer body including a liquid inlet and a spray outlet with a liquid flow circuit defined through the atomizer body for fluid communication of liquid from the inlet to the spray outlet, wherein the liquid flow circuit branches into a plurality of sub-circuits including a first sub-circuit and a second sub-circuit, each configured to produce a spray cone of atomized liquid issuing from the spray outlet, wherein the sub-circuits are mechanically separated from one another to limit interaction of liquid in the sub-circuits and thereby produce a distinct and stable spray cone from each sub-circuit over a range of liquid flow rates, wherein at least one passage fluidly connects the liquid inlet with an annular chamber defined in the atomizer body, wherein the annular chamber is in fluid communication with both of the first and second sub-circuits to supply liquid to both.

2. An atomizer as recited in claim 1, wherein an annular wall separates the annular chamber from a swirl chamber of the first sub-circuit inboard of the annular chamber, wherein the swirl chamber is in fluid communication with the annular chamber to receive liquid therefrom via at least one first sub-circuit passage defined through the annular wall.

3. An atomizer as recited in claim 2, wherein a first metering orifice is in fluid communication with the swirl chamber of the first sub-circuit, wherein the first metering orifice defines an elongate passage through a protrusion defined on an inner distributor mounted to the atomizer body with the protrusion extending axially away from the annular chamber.

4. An atomizer as recited in claim 3, wherein the second sub-circuit includes at least one swirl passage connecting the annular chamber to a second metering orifice defined outboard of the inner distributor and inboard of an outer distributor mounted outboard of the inner distributor.

5. An atomizer as recited in claim 4, wherein the outer distributor extends beyond the inner distributor in a downstream axial direction.

6. An atomizer as recited in claim 4, wherein the second metering orifice defines a converging annular passage between the inner and outer distributors.

7. An atomizer as recited in claim 1, wherein the liquid flow circuit is a first liquid flow circuit, and further comprising a second liquid flow circuit defined through the atomizer body outboard of the first and second sub-circuits.

8. An atomizer as recited in claim 1, wherein each of the sub-circuits is configured to produce a spray cone of atomized liquid issuing from the spray outlet such that the spray cone of each sub-circuit has a different cone angle.

9. An atomizer for producing an atomized spray of liquid comprising: an inner atomizer body including a liquid inlet and liquid outlets wherein a liquid flow circuit is defined through the inner atomizer body from the inlet to the outlets, and wherein the liquid flow circuit includes first and second sub-circuits corresponding to separate liquid outlets; an inner distributor mounted to the inner atomizer body, wherein the inner distributor defines a protrusion with an elongate outlet orifice defined therethrough for fluid communication from an outlet of the first sub-circuit in the inner atomizer body to an outlet of the inner distributor protrusion; and an outer distributor mounted outboard of the inner distributor, the outer distributor defining an outlet orifice outboard of the protrusion of the inner distributor and in fluid communication with an outlet of the second sub-circuit in the inner atomizer body, wherein the protrusion of the inner distributor separates outlet portions of the first and second sub-circuits to limit interaction of liquid in the sub-circuits and thereby produce a distinct and stable spray cone from each sub-circuit over a range of liquid flow rates, wherein at least one passage fluidly connects the liquid inlet with an annular chamber defined in the inner atomizer body, wherein the annular chamber is in fluid communication with both sub-circuits to supply liquid to both.

10. An atomizer as recited in claim 9, wherein an annular wall separates the annular chamber from a swirl chamber of the first sub-circuit inboard of the annular chamber, wherein the swirl chamber is in fluid communication with the annular chamber to receive liquid therefrom via at least one sub-circuit passage defined through the annular wall, and wherein the annular chamber feeds into the outlet orifice of the outer distributor, and wherein the swirl chamber feeds into the outlet orifice of the inner distributor.

11. An atomizer as recited in claim 9, wherein the inner distributor includes at least one swirl passage fluidly connecting the annular chamber of the inner atomizer body to outlet orifice of the outer distributor.

12. An atomizer as recited in claim 9, wherein the outlet orifice of the outer distributor defines a converging annular passage between the inner and outer distributors.

13. An atomizer as recited in claim 9, further comprising an outer atomizer body mounted outboard of the inner atomizer body, wherein a second liquid flow circuit is defined between the inner atomizer body and the outer atomizer body outboard of the first and second sub-circuits.

14. An atomizer for producing an atomized spray of liquid comprising: an inner atomizer body including a liquid inlet and liquid outlets wherein a liquid flow circuit is defined through the inner atomizer body from the inlet to the outlets, and wherein the liquid flow circuit includes first and second sub-circuits corresponding to separate liquid outlets; an inner distributor mounted to the inner atomizer body, wherein the inner distributor defines a protrusion with an elongate outlet orifice defined therethrough for fluid communication from an outlet of the first sub-circuit in the inner atomizer body to an outlet of the inner distributor protrusion; an outer distributor mounted outboard of the inner distributor, the outer distributor defining an outlet orifice outboard of the protrusion of the inner distributor and in fluid communication with an outlet of the second sub-circuit; and an outer atomizer body mounted outboard of the outer distributor and inner atomizer body, with a third sub-circuit defined between the outer atomizer body and the outer distributor, wherein the outer distributor separates outlet portions of the second and third sub-circuits and wherein the protrusion of the inner distributor separates outlet portions of the first and second sub-circuits to limit interaction of liquid in the sub-circuits and thereby produce a distinct and stable spray cone from each sub-circuit over a range of liquid flow rates, wherein at least one passage defined through the inner atomizer body fluidly connects the liquid inlet with an annular chamber defined in the inner atomizer body, wherein the annular chamber is in fluid communication with the first and second sub-circuits to supply liquid to both, and wherein at least one separate passage defined in the inner atomizer body fluidly connects the liquid inlet with the third sub-circuit.

15. An atomizer as recited in claim 14, wherein the outer distributor includes an axially extending protrusion outboard of the protrusion of the inner distributor, and wherein the protrusion of the outer distributor provides mechanical separation between the second and third sub-circuits.

16. An atomizer as recited in claim 14, wherein the third sub-circuit is configured to produce a spray with a wider spray cone angle than that of the second sub-circuit, and wherein the second sub-circuit is configured to produce a spray with a wider spray cone angle than that of the first sub-circuit.

* * * * *